United States Patent [19]

Bartels et al.

[11] 4,440,307

[45] Apr. 3, 1984

[54] CONTAINER ASSEMBLY

[75] Inventors: Herbert D. Bartels, Palos Heights; Leonard A. Maliszewski, Western Springs, both of Ill.

[73] Assignee: The Continental Group, Inc., New York, N.Y.

[21] Appl. No.: 921,035

[22] Filed: Jun. 30, 1978

[51] Int. Cl.[3] ..... B65D 7/00

[52] U.S. Cl. ..... 220/4 B; 220/5 R; 220/8; 220/80

[58] Field of Search ..... 220/4 R, 4 B, 4 C, 4 E, 220/5 R, 5 A, 8, 80, 85 K, 319, 320, 321, 4

[56] References Cited

U.S. PATENT DOCUMENTS

| | | | |
|---|---|---|---|
| 1,492,415 | 4/1924 | Bell | 220/80 |
| 2,258,285 | 10/1941 | Fish | 220/5 R |
| 2,551,484 | 5/1951 | Branning | 220/5 R |
| 3,346,279 | 10/1967 | Stachiw et al. | 220/5 R X |

*Primary Examiner*—Steven M. Pollard
*Attorney, Agent, or Firm*—Charles E. Brown

[57] ABSTRACT

A container assembly formed of two cup-shaped container halves which are combined with their open end portions in telescoped relation and being secured together by way of a coupling sleeve. The coupling sleeve is internal in the preferred embodiment, but may be external. The overlapped free end portions of the container halves may be disposed immediately adjacent one another, or may be separated by the coupling sleeve. Except when the coupling sleeve is located externally, the raw edge of the free end of the inner free end portion is always protected by the coupling sleeve. The coupling sleeve may have a socket in which one or both of the free end portions is seated. The container halves are formed of metal and the coupling sleeve is formed of a plastics material and bonded to a coating on the metal halves.

9 Claims, 5 Drawing Figures

CONTAINER ASSEMBLY

This invention relates in general to new and useful improvements in container construction, and more particularly to a container formed of two cup-shaped halves which are suitably secured together to define a container assembly with a peripheral seam.

It has been found that a high strength container may be formed of light weight metal, either thin steel or slightly thicker aluminum, by forming the metal into cup-shaped halves which then have their free end portions bonded together in any suitable manner including welding. This type of container construction has two specific requirements. First of all, the seam, which is a circumferential seam, must be sufficiently strong to prevent axial separation of the container halves in addition to preventing leakage between the halves. Next, in most instances the product is such that it is necessary to protect against the exposure of the raw edge of the innermost free end portion.

Numerous modes for joining the two container halves have been proposed, but all require the substantially direct securement of the free end portions of the container halves to one another. In accordance with this invention, it is proposed to utilize a coupling sleeve which may be formed of a plastics material and which may be directly bonded to the coating carried by the metal container halves so as to provide for the necessary strength of the seam and protect against leakage. Further, by placing the coupling sleeve internally of the container, the protecting sleeve is always provided with a shoulder recess in abutting engagement with the raw or free edge of the free end portion of the inner container half.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
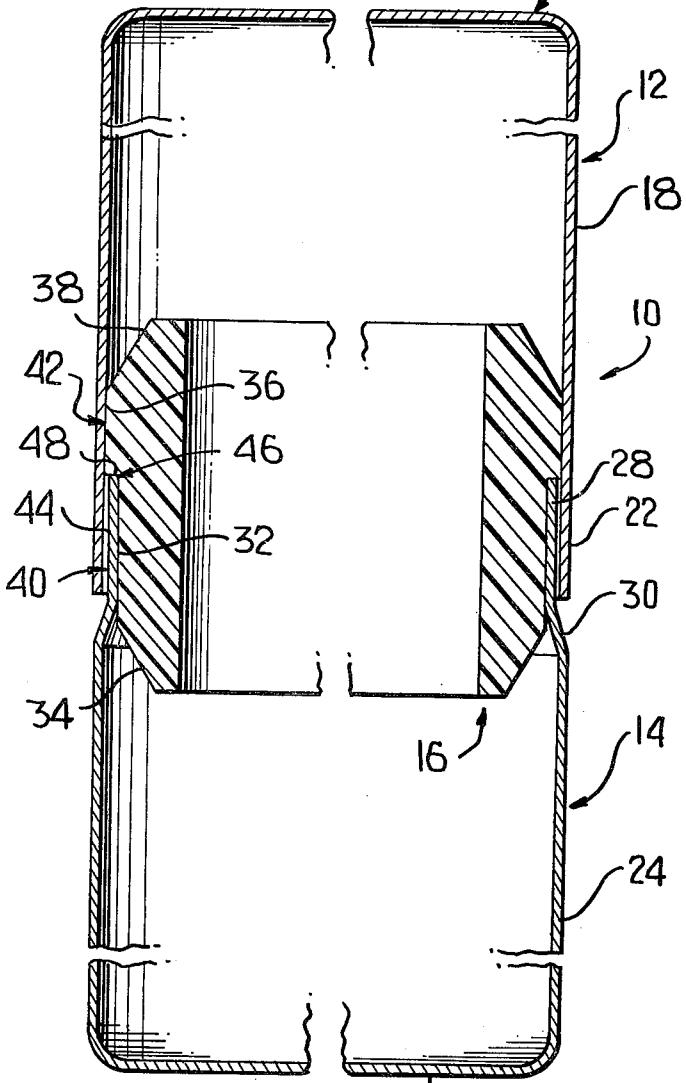
FIG. 1 is an axial sectional view taken through a container in accordance with this invention, and shows generally the details of the container, intermediate portions of the container being broken away and shown in section.

Referring now to the drawings in detail, it will be seen that there is illustrated in FIG. 1 a container formed in accordance with this invention, the container being generally identified by the numeral 10. The container 10 includes a pair of cup-shaped container halves 12, 14 which are secured together by means of a coupling sleeve 16. Each of the container halves 12, 14 is of a cup-shaped configuration with the container half 12 including a container body 18 and a top end 20. The container half 12 also includes a free end portion 22 which is preferably in the form of a continuation of the body 18.

The container half 14 also includes a body 24 which is of the same cross section as the body 18 and is in axial alignment therewith. The bodies 18 and 24 are preferably cylindrical. The container half 14 includes a bottom wall 26. The container half 14 further includes a free end portion 28 which is of a reduced diameter and of a size to be telescoped within the free end portion 28. The free end portion 28 is joined to the body 24 by an offsetting intermediate portion 30.

It is to be noted that in the illustrated embodiment of the container 10 the bottom half 14 has the free end portion thereof disposed innermost. This relationship may be reversed if the coupling sleeve 16 is inverted.

The coupling sleeve 16 includes a cylindrical first coupling surface 32 which is received within the free end portion 28. Assembly of the coupling sleeve 16 into the free end portion 28 is accomplished by means of a cam surface 34 disposed below the cylindrical surface 32.

The coupling sleeve 16 also includes a second cylindrical surface 36 which is axially spaced from the cylindrical surface 32 and is of a diameter greater than the diameter of the cylindrical surface 32 by an amount equal to twice the thickness of the metal of the free end portion 28 plus twice the space required for a bonding material between the two container halves. The upper part of the coupling sleeve 16 includes a ramp or cam surface 38 which leads to the cylindrical surface 36 and facilitates the telescoping of the free end portion 22 over both the coupling sleeve 16 and the free end portion 28.

It is to be understood that the container halves 12, 14 will preferably be formed of metal, such as aluminum and steel, and that at least the inner surface of the container halves 12, 14 will have thereon a suitable coating material. This coating material must be one which will bond under heat conditions to the plastics material of the coupling surface 16 which is preferably formed of polypropylene. Thus, a bond 40 will be formed between the coupling sleeve 16 and the inner surface of the free end portion 28. A similar bond 42 will be formed between the coupling sleeve 16 and the inner surface of the free end portion 22. Finally, the container halves 12, 14 may have an external coating and a bond 44 is formed between the overlapped free end portions 22, 28.

It will be seen that the difference in diameters of the cylindrical surfaces 32, 36 results in the formation of a shoulder 46 against which the free edge 48 of the free end portion 28 abuts so that the free edge 48, which is extremely difficult to protect by way of a coating, is protected from the contents of the container 10 by both the coupling sleeve 16 and the free end portion 22.

Figure 2:
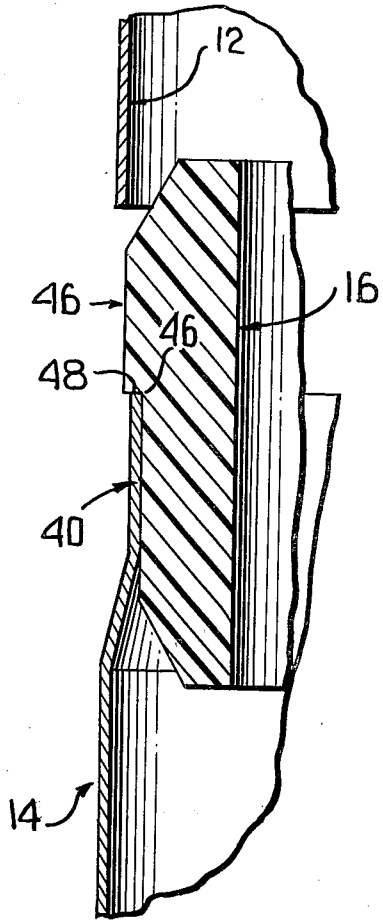
FIG. 2 is a fragmentary sectional view taken through the container, showing the manner in which the two container halves are joined together by the coupling sleeve.

Referring now to FIG. 2, it will be seen that the container halves 12, 14 may be readily joined together by first inserting the coupling sleeve 16 into the container half 14 until the free edge 48 thereof abuts the shoulder 46. Then the container half 12 is telescoped down over the coupling sleeve 16 until the container is of a preselected height. After this, heat is applied in any desired manner to effect the afore discussed bonding.

While the coupling sleeve 16 is preferably disposed interiorly of the container, it will be seen that a very similar coupling sleeve 50 may externally surround the container halves 12, 14. In this event, the free end portion of the container 14, identified by the numeral 52, is disposed outermost, with the free end portion 54 of the container half 12 being disposed innermost. The net result is the same as the container 101 but wherein the raw edge 56 of the free end portion 54 is exposed to the contents of the container. The container of FIG. 3 is generally identified by the numeral 60.

Figure 4:
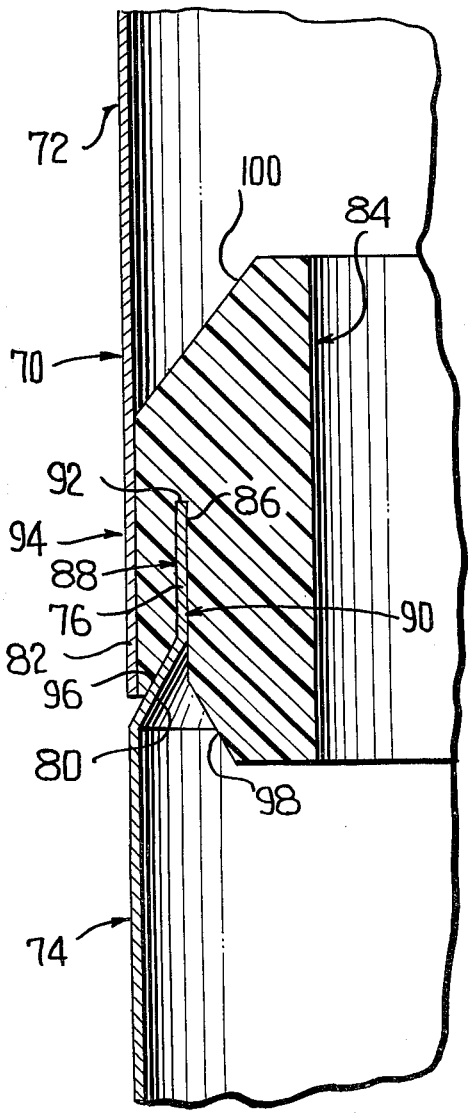
FIG. 4 is a fragmentary sectional view taken through a further form of container with a modified coupling arrangement.

Reference is now made to FIG. 4 where a slightly different container is illustrated. The container, which is identified by the numeral 70, includes a container half 72 which may be identical to the container half 12. It also includes a container half 74 which is modified slightly from the container half 14 in that it has a free end portion 76 joined to the body 78 thereof by a relatively greatly sloping intermediate portion 80 wherein the free end portion 76 of the container half 74 is spaced a considerable distance radially inwardly of the free end portion leading to the container half 72. The container halves 72, 74 are joined by a coupling sleeve 84 which has formed therein a seat or socket 86 receiving the free edge portion 76. When the container half 74 has both an internal and an external coating, bonds 88, 90 may be formed between the free end portion 76 and the coupling sleeve 84. Thus, the raw edge 92 of the free end portion 76 is not only in abutment with the coupling sleeve 84 but is also protected against the contents of the container 70 by the bonds 88, 90.

A further cylindrical bond 94 is formed between the external surface of the coupling sleeve 84 and the free end portion 82 of the container half 72.

Figure 3:
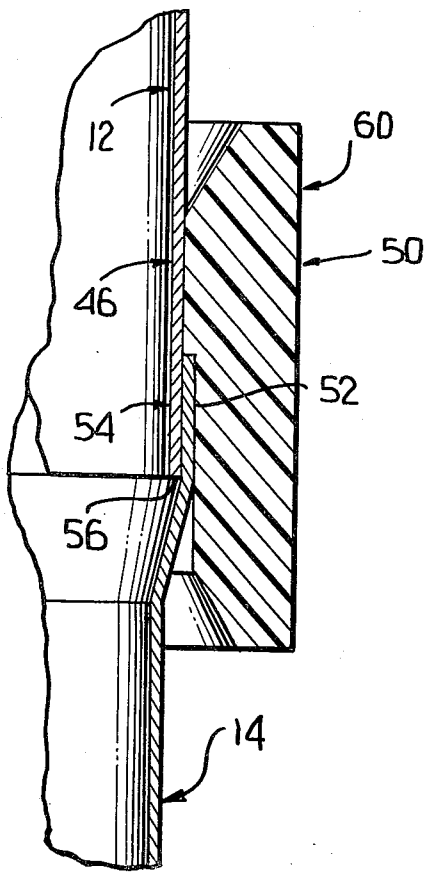
FIG. 3 is a fragmentary sectional view taken through a modified form of container wherein the coupling sleeve is disposed externally.

Although the coupling sleeve 84 has been illustrated as being internal, it is to be understood that it may be external, if so desired, in the manner shown in FIG. 3.

The socket 86 has positioned adjacent thereto a pair of cam or ramp surfaces 96, 98 to facilitate the insertion of the free end portion 76 into the socket 86. A further cam or ramp surface 100 leads to the external surface of the coupling sleeve 84 to facilitate the telescoping of the coupling sleeve 84 into the free end portion 82 of the container half 72.

Figure 5:
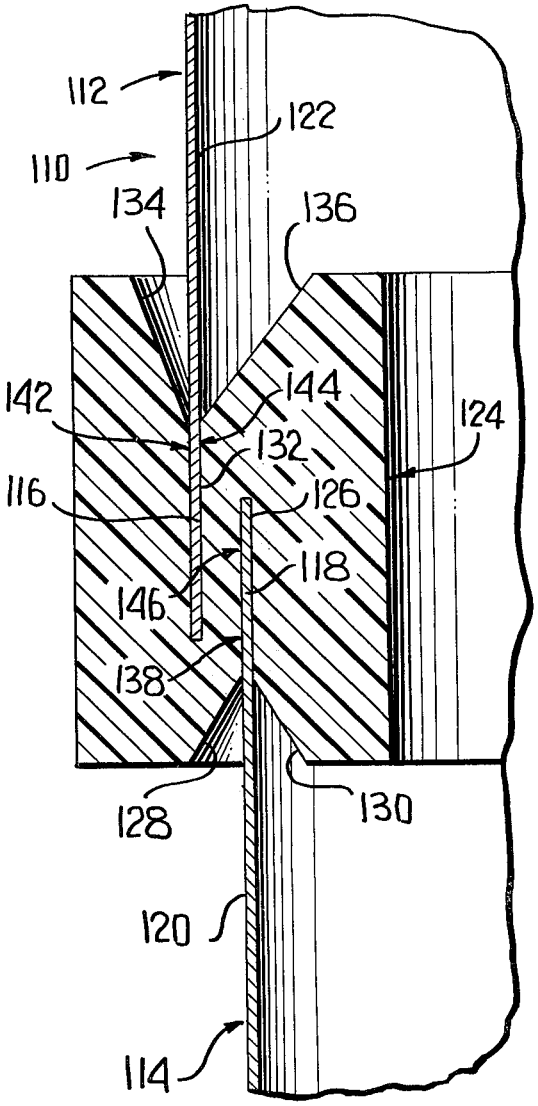
FIG. 5 is a sectional view similar to FIG. 4 through still another form of container coupling.

In FIG. 5 there is illustrated still another form of container, generally identified by the numeral 110. The container 110 is formed of two container halves 112, 114 having free end portions 116, 118, respectively, in telescoped but radially spaced relation. It is to be understood that the container half 114 has a body 120 of a reduced diameter as compared to that of the body 112 of the container half 112. This differs from the container half arrangement of FIGS. 1–4 where the bodies of the container halves are of substantially the same diameter.

The container halves 112, 114 are joined together by a coupling sleeve 124. The coupling sleeve 124 has a lower annular seat or socket 126 into which the free end portion 118 is guided by means of a pair of cam or ramp surfaces 128, 130.

The coupling sleeve 124 is also provided with a socket or seat 132 which receives the free end portion 116. Leading into the socket 132 are cam or ramp surfaces 134, 136 so as to facilitate the assembling of the coupling sleeve 124 with the container half 112.

Once again, the coupling sleeve is formed of a bondable plastics material, such as polypropylene, and the inner and outer surfaces of at least the end portions of the container halves 112, 114 have a protective coating thereon which is bondable to the plastic material of the coupling sleeve 124.

In order to assemble the container 110, the container halves 112, 114 are merely pressed into telescoping relation with respect to the coupling sleeve 124, after which heat is applied to bond the coatings of the container halves with the plastics material of the coupling sleeve 124. Thus bonds 138, 140 are formed between the coating materials of the opposite faces of the container half 114 and the coupling sleeve 124. Similar bonds 142, 144 are formed between the container half 112 and the coupling sleeve 124.

It is to be noted that the raw edges of both container halves 112, 114 are fully protected by the coupling sleeve 124. The arrangement of the coupling sleeve 124 is such that even if the coupling sleeve were modified in cross section so that the container body half 120 were of a larger diameter than the body 122 of the container half 112, the raw edge of the innermost container half would still be protected.

Although only several preferred embodiments of the container assembly of this invention have been specifically illustrated and described herein, it is to be understood that minor variations may be made in the container assembly without departing from the spirit and scope of the invention as defined by the appended claims.

We claim:

1. A container assembly comprising a pair of cup-shaped container halves and a coupling sleeve, said container halves including first and second container halves having free ends of different diameters and including an outer free end portion and an inner free end portion each terminating in a free end, said inner and outer free end portions being in telescoped relation with one another and with said coupling sleeve, said free end portions being disposed entirely to one side of said coupling sleeve in a radial direction, said coupling sleeve being disposed radially inwardly of said free end portions.

2. The container assembly of claim 1 wherein said free end of said inner free end portion is shielded from the interior of said container assembly by said coupling sleeve and said outer free end portion.

3. The container assembly of claim 2 wherein said coupling sleeve has an abutment shoulder engaging said free end of said inner free end portion.

4. A container assembly comprising a pair of cup-shaped container halves and a coupling sleeve, said container halves include first and second container halves having free ends of different diameters and including an outer free end portion and an inner free end portion each terminating in a free end, said inner and outer free end portions being in telescoped relation with one another and with said coupling sleeve, said coupling sleeve having a socket receiving at least one of said free end portions.

5. The container assembly of claim 4 wherein said coupling sleeve has a socket receiving each of said free end portions.

6. The container assembly of claim 4 wherein said coupling sleeve socket is disposed entirely to one side of the other of said free end portions in a radial direction.

7. The container assembly of claim 6 wherein said coupling sleeve is disposed radially inwardly of said other free end portion.

8. The container assembly of claim 6 wherein said coupling sleeve is disposed radially outwardly of said other free end portion.

9. A container assembly comprising a pair of cup-shaped container halves and a coupling sleeve, said container halves include first and second container halves having free ends of different diameters and including an outer free end portion and an inner free end portion each terminating in a free end, said inner and outer free end portions being in telescoped relation with one another and with said coupling sleeve, said container halves being formed of metal and said coupling sleeve being formed of a plastics material, and said container halves having thereon a coating self-bonded to said plastics material coupling sleeve.

* * * * *